US006733206B2

(12) United States Patent
Stasiewich et al.

(10) Patent No.: US 6,733,206 B2
(45) Date of Patent: May 11, 2004

(54) GROUND COVER MAT

(76) Inventors: David Stasiewich, 60 Reichert Dr., Beaumont, Alberta (CA), T4X 1L3; James Stasiewich, 659 Lee Ridge Rd., Edmonton, Alberta (CA), T6K 0N9

( * ) Notice: Subject to any disclaimer, the term of this patent is extended or adjusted under 35 U.S.C. 154(b) by 0 days.

(21) Appl. No.: 10/107,504

(22) Filed: Mar. 26, 2002

(65) Prior Publication Data

US 2002/0176745 A1 Nov. 28, 2002

(30) Foreign Application Priority Data

May 23, 2001 (CA) ..... 2348328
Dec. 12, 2001 (CA) ..... 2364968

(51) Int. Cl.[7] ..... E01C 5/00
(52) U.S. Cl. ..... 404/41; 404/35
(58) Field of Search ..... 404/14, 34, 35, 404/41

(56) References Cited

U.S. PATENT DOCUMENTS 3,202,067 A * 8/1965 Michard et al. ..... 404/17
5,098,218 A * 3/1992 Reese et al. ..... 404/35
5,810,511 A 9/1998 Schmidt ..... 405/52
5,971,655 A * 10/1999 Shirakawa ..... 404/40

* cited by examiner

*Primary Examiner*—Robert E. Pezzuto
*Assistant Examiner*—Tara L. Mayo
(74) *Attorney, Agent, or Firm*—Davis & Bujold, PLLC

(57) ABSTRACT

A ground cover mat includes a first end interlock at a first end of the body which is adapted to interlock with a second end interlock at a second end of a like body. A second end interlock is provided at the second end of the body which is adapted to interlock with the first end interlock at a first end of a like body. A first side interlock is provided at a first side of the body which is adapted to interlock with a second side interlock at a second side of an adjacent like body. A second side interlock is provided at the second side of the body which is adapted to interlock with the first side interlock at a second end of an adjacent like body.

4 Claims, 3 Drawing Sheets

GROUND COVER MAT

FIELD OF THE INVENTION

The present invention relates to a ground cover mat

BACKGROUND OF THE INVENTION

Canadian Patent 2,348,328 (Stasiewich 2001) describes a ground cover mat. There is a danger when these ground cover mats are used, that injuries may occur as a result of persons stepping into spaces between adjacent mats.

SUMMARY OF THE INVENTION

What is required is a ground cover mat that addresses the above concern.

According to the present invention there is provided a ground cover mat which includes a rectangular body having a first end, a second end, a first side and a second side. A first end interlock is provided at a first end of the body which is adapted to interlock with a second end interlock at a second end of a like body. A second end interlock is provided at the second end of the body which is adapted to interlock with the first end interlock at a first end of a like body. A first side interlock is provided at a first side of the body which is adapted to interlock with a second side interlock at a second side of an adjacent like body. A second side interlock is provided at the second side of the body which is adapted to interlock with the first side interlock at a second end of an adjacent like body.

With ground cover mats, as described above, the first side interlock and the second side interlock prevent adjacent mats from moving apart. This prevents spaces developing between adjacent mats which a person might break a leg if one inadvertently step into one of such spaces. It is preferred that the first side interlock include at least one downwardly directed hook which extends laterally from the first side. It is preferred that the second side interlock include means for engaging the at least one downwardly directed hook is positioned along the second side. The downwardly directed hook of the body is engaged by the engagement means on an adjacent body to prevent lateral separation of the body and the adjacent body.

In a first embodiment of ground cover mat constructed in accordance with the teachings of the present invention the means for engaging the at least one downwardly directed hook is at least one upwardly directed hook extending laterally from the second side. The downwardly directed hook of the body engages the upwardly directed hook of the adjacent body to prevent lateral separation of the body and the adjacent body.

Although beneficial results may be obtained through the use of the ground cover mats described above, in remote areas populated by hooved animals, such as deer; environmentalists have expressed concerns that injuries may occur as a result of the animals stepping into spaces between adjacent mats. There is, therefore, a need in such environments to provide even closer adjacent spacing.

In a second embodiment of ground cover mat constructed in accordance with the teachings of the present invention, the means for engaging the at least one downwardly directed hook is at least one slotted opening along the second side. The downwardly directed hook of the body engages the slotted opening along the second side of the adjacent body to prevent lateral separation of the body and the adjacent body.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
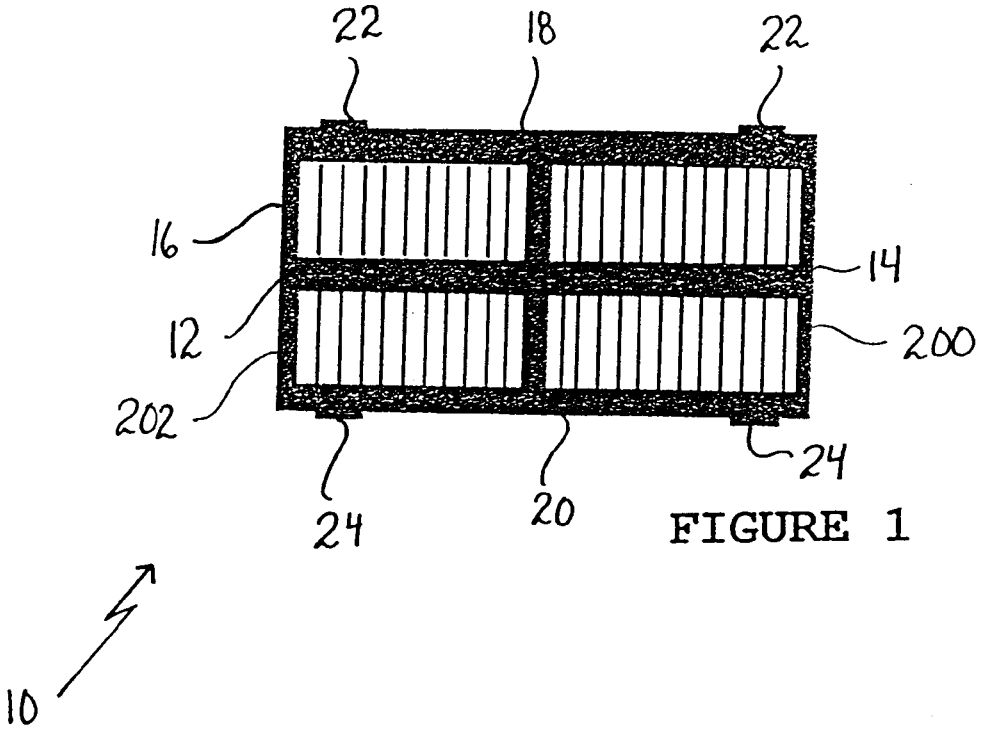
FIG. 1 is a top plan view of a first embodiment of ground cover mat constructed in accordance with the teachings of the present invention.

Two preferred embodiments of ground cover mats will now be described. A first embodiment of ground cover mat, generally identified by reference numeral 10, will be described with reference to FIGS. 1 and 2. A second embodiment of ground cover mat, generally identified by reference numeral 100, will be described with reference to FIGS. 3 and 4.

First Embodiment

Figure 2:
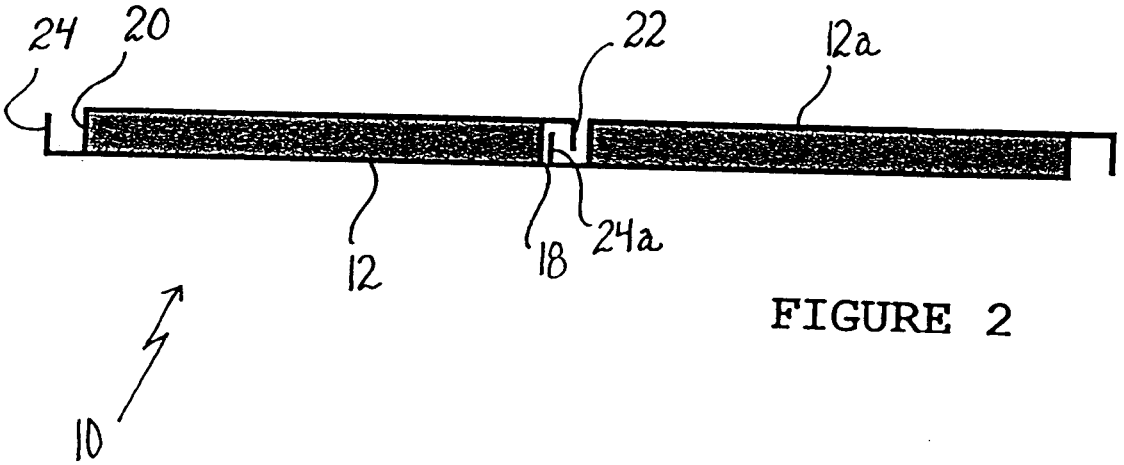
FIG. 2 is an end elevation view, in section, of the ground cover mat illustrated in FIG. 1, coupled to an adjacent ground cover mat.

Referring to FIG. 1, Ground cover mat 10 includes a rectangular body 12 having a first end 14, a second end 16, a first side 18 and a second side 20. Means is provided for interlocking first end 14 of body 12 to second end 16 of a like body. A first end interlock 200 is positioned at first end 14 of body 12 which is adapted to interlock with second end interlock 202 at second end 16 of a like body. A second end interlock 202 is positioned at second end 16 of body 12 which is adapted to interlock with first end interlock 200 at first end 14 of a like body. First end interlock 200 and second end interlock 202 will be hereinafter described in relation to FIG. 3. It will be appreciated, however, that alternative forms of interlock could be used at first end 14 and second end 16 of body 12. Referring to FIGS. 1 and 2, a first side interlock is provided in the form of two downwardly directed hooks 22 which extend laterally from first side 18. In this first embodiment, a second side interlock which serves as means for engaging downwardly directed hooks 22 are upwardly directed hooks 24 extending laterally from second side 20. Referring to FIG. 2, downwardly directed hooks 22 of body 12 engage upwardly directed hooks 24*a* of an adjacent body 12*a* to prevent lateral separation of body 12 and adjacent body 12*a*.

Second Embodiment

Figure 3:
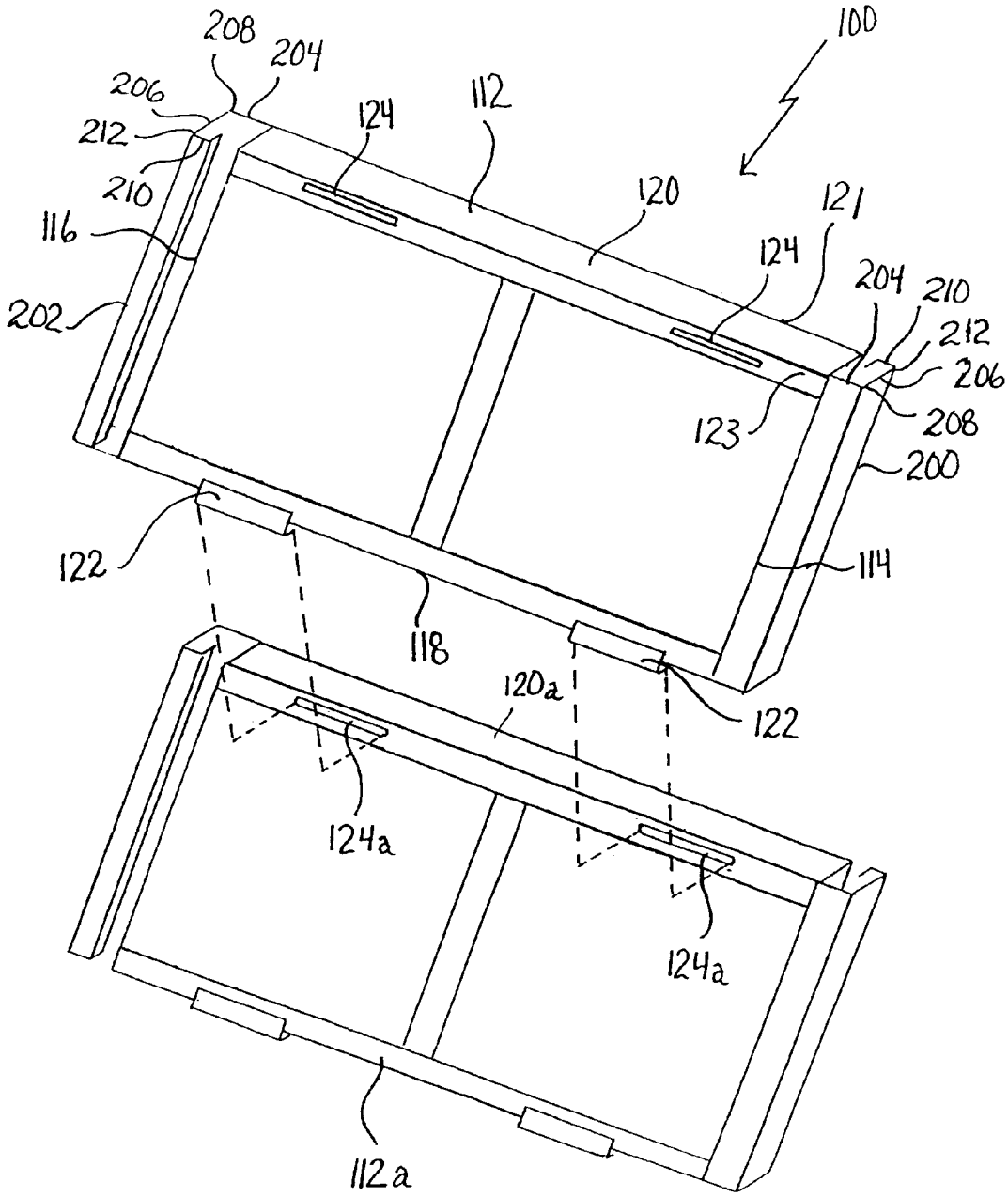
FIG. 3 is an exploded perspective view of a second embodiment of ground cover mat constructed in accordance with the teachings of the present invention, being coupled to an adjacent ground cover mat.
Figure 4:
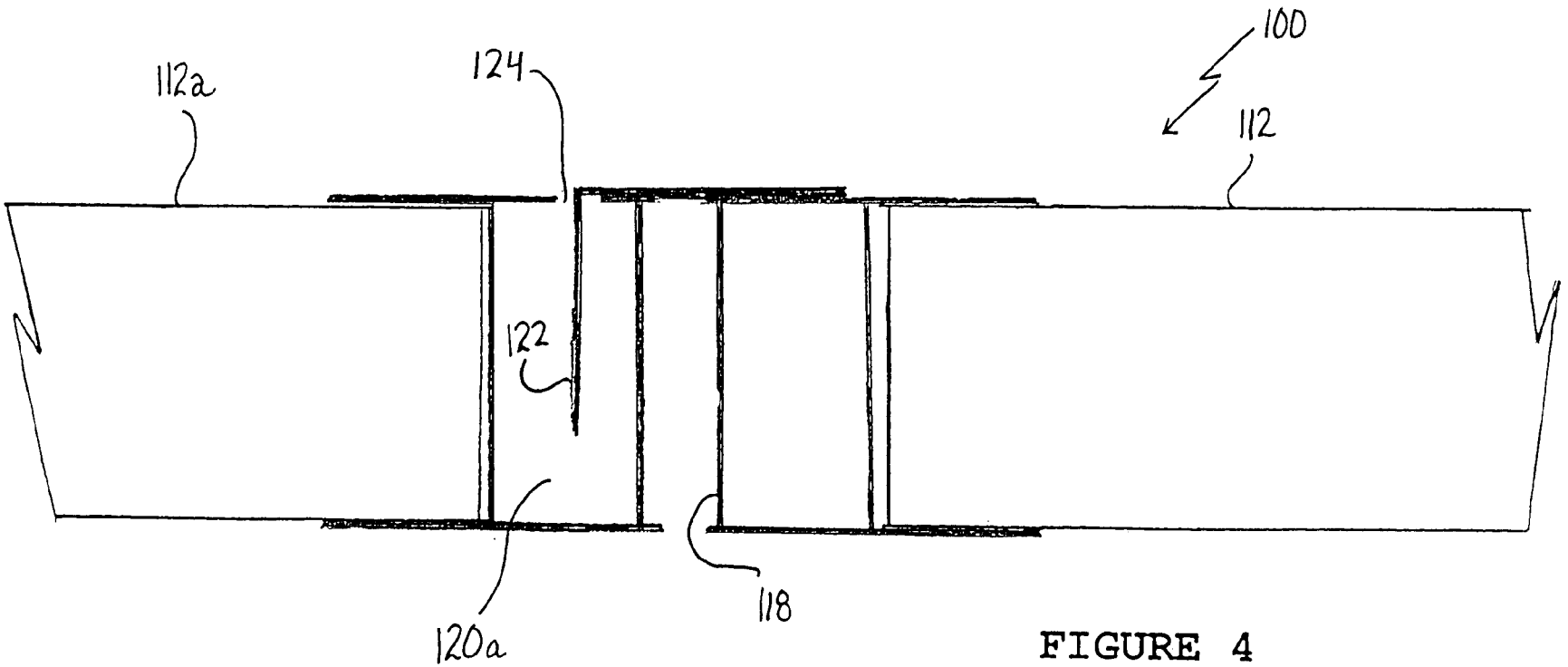
FIG. 4 is an end elevation view, in section, of the ground cover mat illustrated in FIG. 3, coupled to an adjacent ground cover mat.

Referring to FIG. 3, ground cover mat 100 includes a rectangular body 112 having a first end 114, a second end 116, a first side 118, a second side 120, a first face 121 and a second face 123. A first end interlock 200 is positioned at first end 114 of body 112 which is adapted to interlock with second end interlock 202 at second end 116 of a like body. A second end interlock 202 is positioned at second end 116 of body 112 which is adapted to interlock with first end interlock 200 at first end 114 of a like body. First end interlock 200 has an outwardly extending portion 204 that extends outwardly from first end 114 of body 112 adjacent to second face 123, an angled portion 206 that extends from a remote end 208 of outwardly extending portion 204 toward but not past first face 121, and an inwardly extending retaining lip 210 that extends from a remote end 212 of angled portion 206 back toward first end 114. Second end interlock 202, similarly, has an outwardly extending portion 204 that extends outwardly from second end 116 of body 112 adjacent to first face 121, an angled portion 206 that extends from a remote end 208 of outwardly extending portion 204 toward but not past second face 123, and an inwardly extending retaining lip 210 that extends from a remote end 212 of angled portion 206 back toward second end 116. Referring to FIGS. 3 and 4, a first side interlock is provided in the form of two downwardly directed hooks 122 which extend laterally from first side 118. In this second embodiment, a second side interlock which serves as means for engaging downwardly directed hooks 118 are slotted openings 124 along second side 120. The downwardly directed hooks 118 of body 112 engage slotted openings 124*a* along second side 120*a* of an adjacent body 112*a* to prevent lateral separation of body 112 and adjacent body 112*a*.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A ground cover mat, comprising:

a rectangular body having a first end, a second end, a first side and a second side;

a first end interlock at a first end of the body adapted to interlock with a second end interlock at a second end of a first identical adjacent body, the first end interlock including at least one downwardly directed hook extending from the first end with an integrally formed first vertical stop;

a second end interlock at the second end of the body, adapted to interlock with the first end interlock at a first end of a second identical adjacent body, the second end interlock including at least one upwardly directed hook extending from the second end with an integrally formed second vertical stop;

the first end interlock and the second end interlock accommodating limited relative vertical movement until the first vertical stop engages the second vertical stop;

a first side interlock at a first side of the body adapted to interlock with a second side interlock at a second side of a third identical adjacent body, the first side interlock includes more than one downwardly directed hook arranged in spaced relation and extending laterally from the first side; and a second side interlock at the second side of the body, adapted to interlock with the first side interlock at a second side of a fourth identical adjacent body, the second side interlock including more than one hook engaging means.

2. The ground cover mat as defined in claim 1, wherein the hook engaging means of the second side interlock are upwardly directed hooks extending laterally from the second side.

3. The ground cover mat as defined in claim 1, wherein the hook engaging means of the second side interlock are slotted openings along the second side.

4. A ground cover mat assembly, comprising:

at least five substantially identical ground cover mats, each ground cover mat including:

a rectangular body having a first end, a second end, a first side and a second side;

a first end interlock at a first end of the body in the form of a downwardly directed hook extending from the first end with an integrally formed first vertical stop;

a second end interlock at the second end of the body in the form of an upwardly directed hook extending from the second end with an integrally formed second vertical stop;

the first end interlock and the second end interlock accommodating limited relative vertical movement until the first vertical stop engages the second vertical stop;

a first side interlock at a first side of the body in the form of more than one downwardly directed hook arranged in spaced relation and extending laterally from the first side; and a second side interlock at the second side of the body in the form of more than one hook engaging means;

the first end interlock of a first of the ground cover mats engaging the second end interlock of a second of the ground cover mats;

the second end interlock of the first of the ground cover mats engaging the first end interlock of a third of the ground cover mats;

the first side interlock of the first of the ground cover mats engaging the second side interlock of a fourth of the ground cover mats; and the second side interlock of the first of the ground cover mats engaging the first side interlock of a fifth of the ground cover mats.

* * * * *